US009244387B2

(12) United States Patent
Harada et al.

(10) Patent No.: US 9,244,387 B2
(45) Date of Patent: Jan. 26, 2016

(54) DEVELOPER COLLECTING DEVICE FOR SUPPRESSING DECREASE OF DEVELOPER COLLECTION RATE AND IMAGE FORMING APPARATUS

(71) Applicant: Kyocera Document Solutions Inc., Osaka (JP)

(72) Inventors: Kaori Harada, Osaka (JP); Shinsaku Yoneda, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/488,540

(22) Filed: Sep. 17, 2014

(65) Prior Publication Data

US 2015/0078776 A1 Mar. 19, 2015

(30) Foreign Application Priority Data

Sep. 18, 2013 (JP) ..... 2013-192496

(51) Int. Cl.
*G03G 15/00* (2006.01)
*G03G 15/095* (2006.01)
*G03G 21/10* (2006.01)

(52) U.S. Cl.
CPC ..... *G03G 15/095* (2013.01); *F24F 2221/22* (2013.01); *G03G 21/105* (2013.01)

(58) Field of Classification Search
CPC ..... G03G 2221/0094; G03G 2221/1654; G03G 15/095; G03G 21/10–21/12; F24F 2221/22
USPC ..... 399/92, 98, 99, 624
See application file for complete search history.

(56) References Cited

U.S. PATENT DOCUMENTS

| | | | | | |
|---|---|---|---|---|---|
| 4,610,534 | A * | 9/1986 | Ito et al. | 399/349 |
| 4,903,084 | A * | 2/1990 | Baltrus et al. | 399/355 |
| 5,028,959 | A * | 7/1991 | Gooray | 399/93 |
| 5,115,760 | A * | 5/1992 | Maeda | 118/621 |
| 5,349,427 | A * | 9/1994 | Benedict et al. | 399/360 |
| 5,761,577 | A * | 6/1998 | Walsh et al. | 399/99 |
| 5,950,055 | A * | 9/1999 | Yahata et al. | 399/252 |
| 6,480,685 | B2 * | 11/2002 | Jones et al. | 399/98 |
| 7,853,173 | B2 * | 12/2010 | Perez | 399/109 |
| 2007/0065171 | A1 * | 3/2007 | Koshimura et al. | 399/99 |
| 2011/0129249 | A1 * | 6/2011 | Koshimura et al. | 399/99 |

FOREIGN PATENT DOCUMENTS

| | | | |
|---|---|---|---|
| JP | 11327295 | A * | 11/1999 |
| JP | 2007-298782 | A | 11/2007 |

* cited by examiner

*Primary Examiner* — Clayton E LaBalle
*Assistant Examiner* — Trevor J Bervik
(74) *Attorney, Agent, or Firm* — James W. Judge

(57) ABSTRACT

A developer collecting device includes a suction duct, a collecting box, and a suction mechanism. The suction duct has one end adjacent to a development device and another end. The collecting box is connected to the other end and configured to suction and collect developer around the development device via the suction duct. The suction mechanism is disposed in the middle of the suction duct. The suction mechanism includes a suction port that is openable and closable. The suction mechanism is configured to suction the developer inside the suction duct from an outside of the suction duct.

5 Claims, 9 Drawing Sheets

DEVELOPER COLLECTING DEVICE FOR SUPPRESSING DECREASE OF DEVELOPER COLLECTION RATE AND IMAGE FORMING APPARATUS

INCORPORATION BY REFERENCE

This application is based upon, and claims the benefit of priority from, corresponding Japanese Patent Application No. 2013-192496 filed in the Japan Patent Office on Sep. 18, 2013, the entire contents of which are incorporated herein by reference.

BACKGROUND

Unless otherwise indicated herein, the description in this section is not prior art to the claims in this application and is not admitted to be prior art by inclusion in this section.

There is known a developer collecting device that suctions and collects toner particles (developer) scattered in a development device in an image forming apparatus. This developer collecting device includes a toner suction duct, in which a suction port is located adjacent to the development device, and a toner collecting part, which is connected to the toner suction duct and suctions and collects the toner particles scattered in the development device via the toner suction duct.

SUMMARY

A developer collecting device according to the disclosure includes a suction duct, a collecting box, and a suction mechanism. The suction duct has one end adjacent to a development device and another end. The collecting box is connected to the other end and configured to suction and collect developer around the development device via the suction duct. The suction mechanism is disposed in the middle of the suction duct. The suction mechanism includes a suction port that is openable and closable. The suction mechanism is configured to suction the developer inside the suction duct from an outside of the suction duct.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
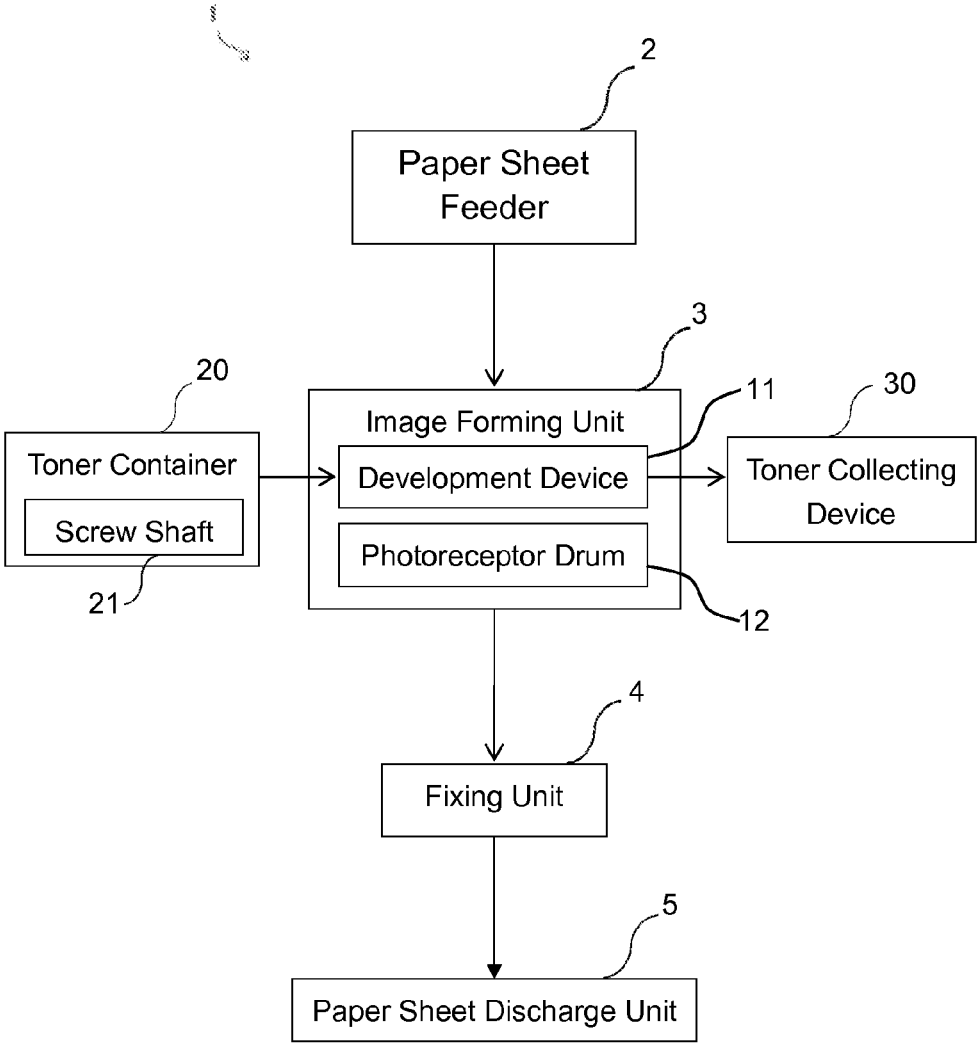
FIG. 1 illustrates a configuration of an image forming apparatus according to an embodiment of the disclosure.
Figure 2:
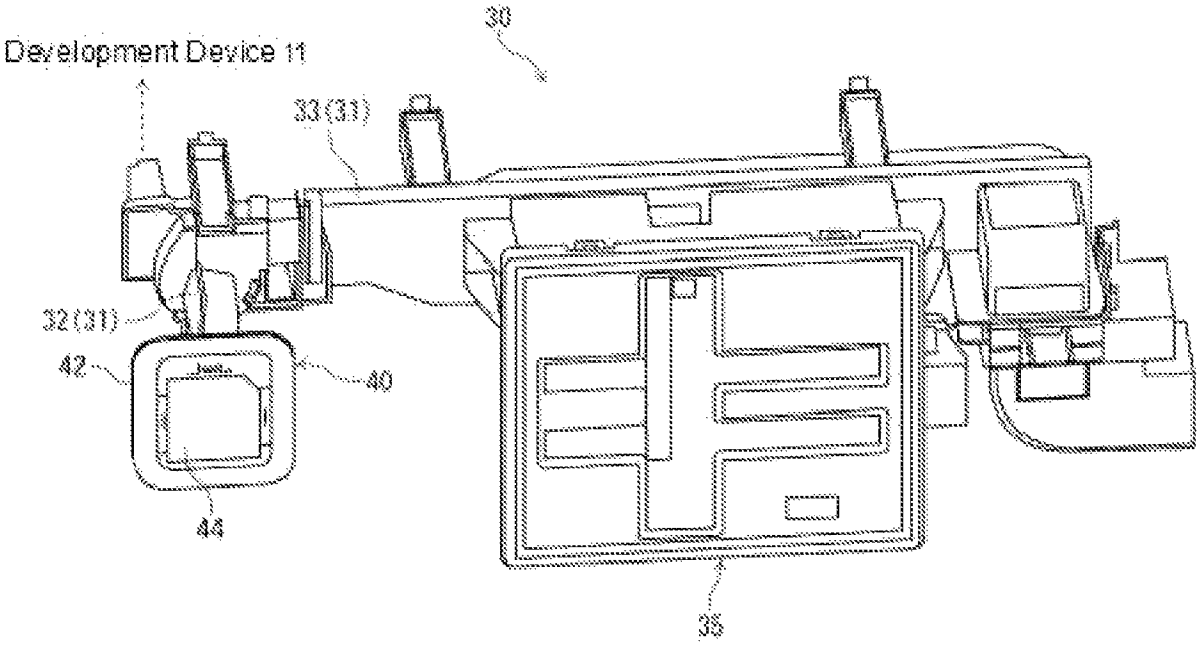
FIG. 2 illustrates a configuration of a toner collecting device according to the embodiment.
Figure 3:
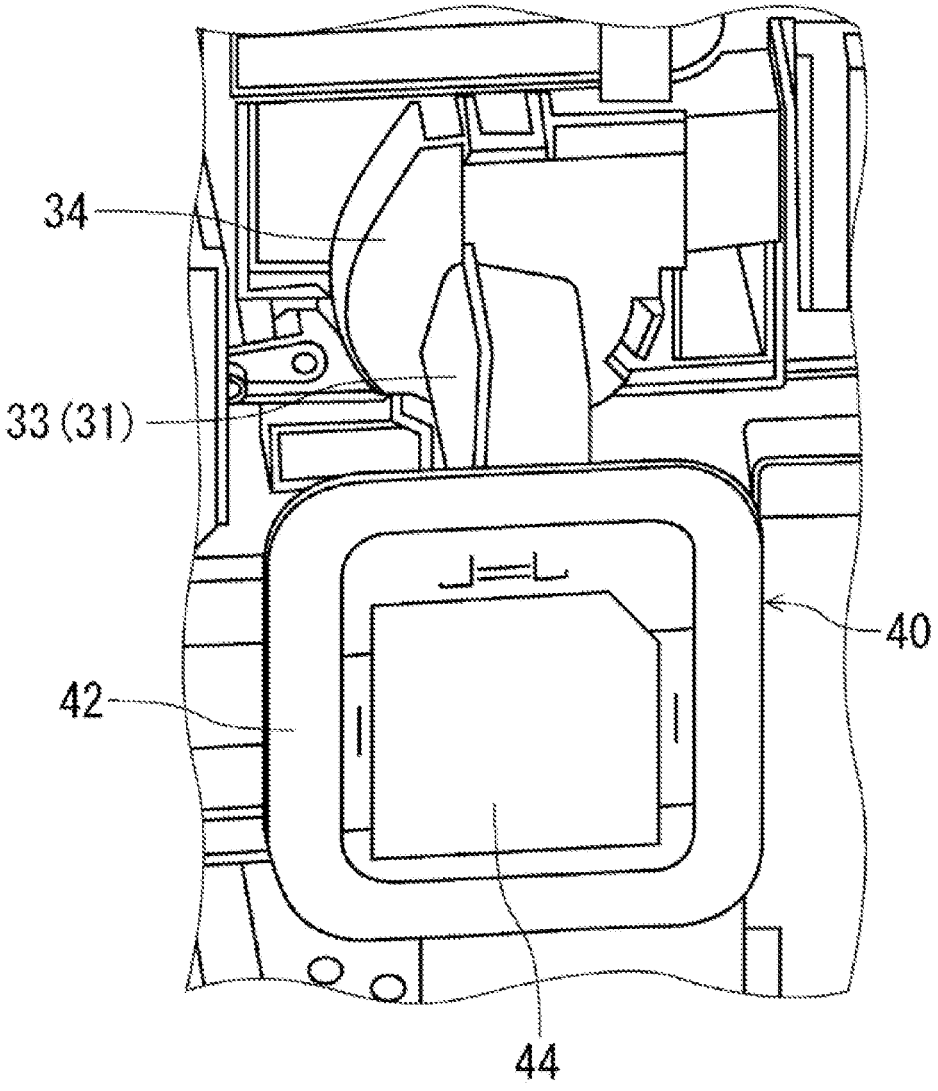
FIG. 3 diagonally illustrates a configuration of a flange portion of a suction mechanism according to the embodiment where a cover is mounted.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

Hereafter, a description will be given of the embodiments of the disclosure with reference to the drawings. The disclosure will not be limited to the embodiments described below.

An image forming apparatus 1 according to the embodiment is such as a laser printer or a multi-functional peripheral. The image forming apparatus 1 is constituted so as to form an image on a paper sheet based on an image data transmitted from a terminal or similar (not illustrated) while conveying the paper sheet. As illustrated in FIG. 1, the image forming apparatus 1 includes a paper sheet feeder 2, an image forming unit 3, a fixing unit 4, and a paper sheet discharge unit 5.

The paper sheet feeder 2 is a cassette paper sheet feeder or a manual bypass tray where supplying the paper sheet to the image forming unit 3. The image forming unit 3 includes a development device 11, a photoreceptor drum 12, or similar. In the image forming unit 3, an electrostatic latent image is formed onto the photoreceptor drum 12 by a light scanning device (not illustrated). The development of the formed electrostatic latent image with the development device 11 forms a toner image that is an image formed of developer. The toner image is transferred to the paper sheet supplied from the paper sheet feeder 2. The fixing unit 4 includes a fixing roller and a pressure roller (both not illustrated). The fixing unit 4 fixes the toner image, which has been transferred in the image forming unit 3 onto the paper sheet, to this paper sheet. This forms the image on the paper sheet. The paper sheet discharge unit 5 includes a sheet discharge tray (not illustrated) where the image formed paper sheet is supplied from the fixing unit 4.

In addition, the image forming apparatus 1 includes a toner container 20 and a toner collecting device 30. The toner container 20 houses a toner as the developer to be supplied to the development device 11. The toner container 20 includes a screw shaft 21 that is a toner conveyance member. The toner container 20 supplies the toner to the development device 11 with the rotation of the screw shaft 21. The toner collecting device 30 (developer collecting device) functions to suction and collect the toner particles (developer) scattered in the development device 11.

Toner Collecting Device

The configuration of the toner collecting device 30 will be described with reference to FIGS. 2 to 7. The toner collecting device 30 includes a suction duct 31 and a collecting box 35.

The suction duct 31 includes one end, which is an inlet end and located adjacent to the development device 11, and another end, which is an outlet end and connected to the collecting box 35. The suction duct 31 serves as a suction passage for the toner. The suction duct 31 is bent at a bending portion 34 in the middle to form a duct upstream part 32 at the development device 11 side and a duct downstream part 33 at the collecting box 35 side with respect to the bending portion 34. In the embodiment, the bending portion 34 of the suction duct 31 bends at substantially right angle, but the bending angle is not limited to the embodiment.

Figure 5:
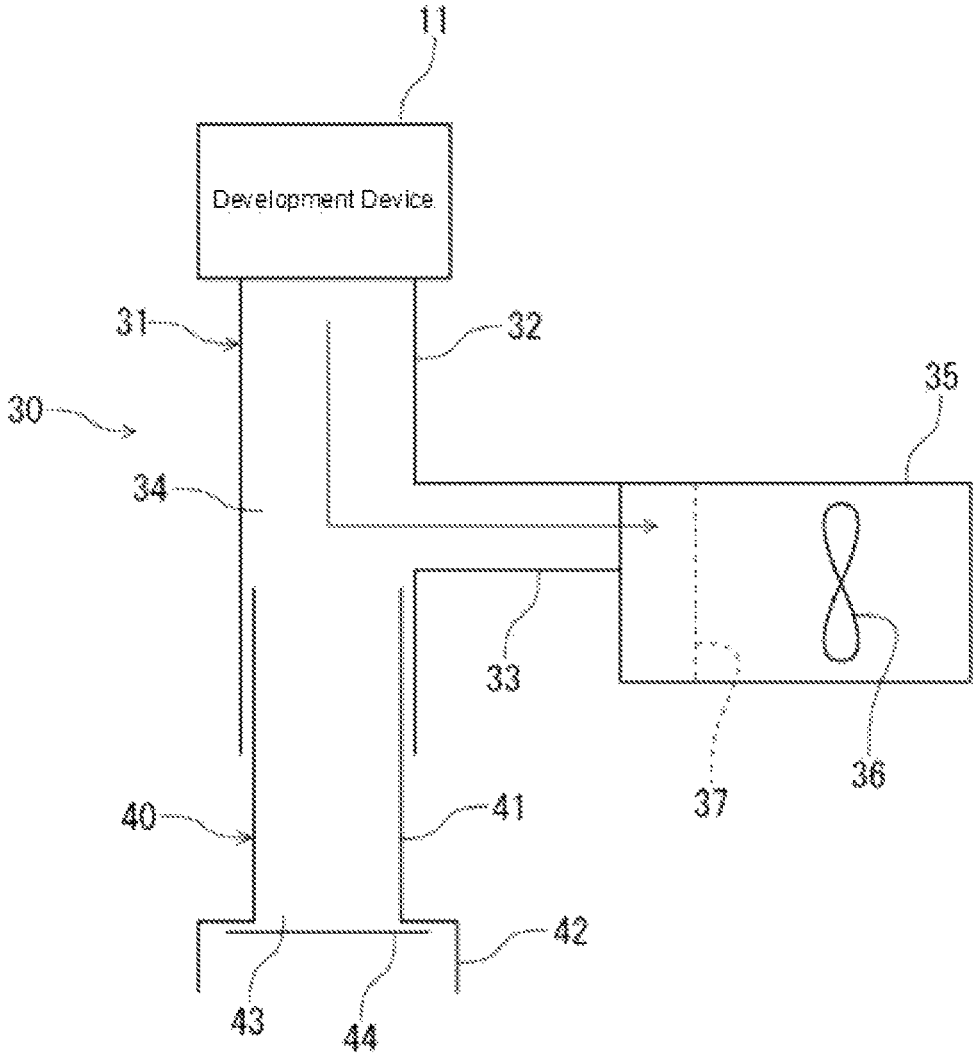
FIG. 5 schematically illustrates a configuration of the toner collecting device according to the embodiment.
Figure 6:
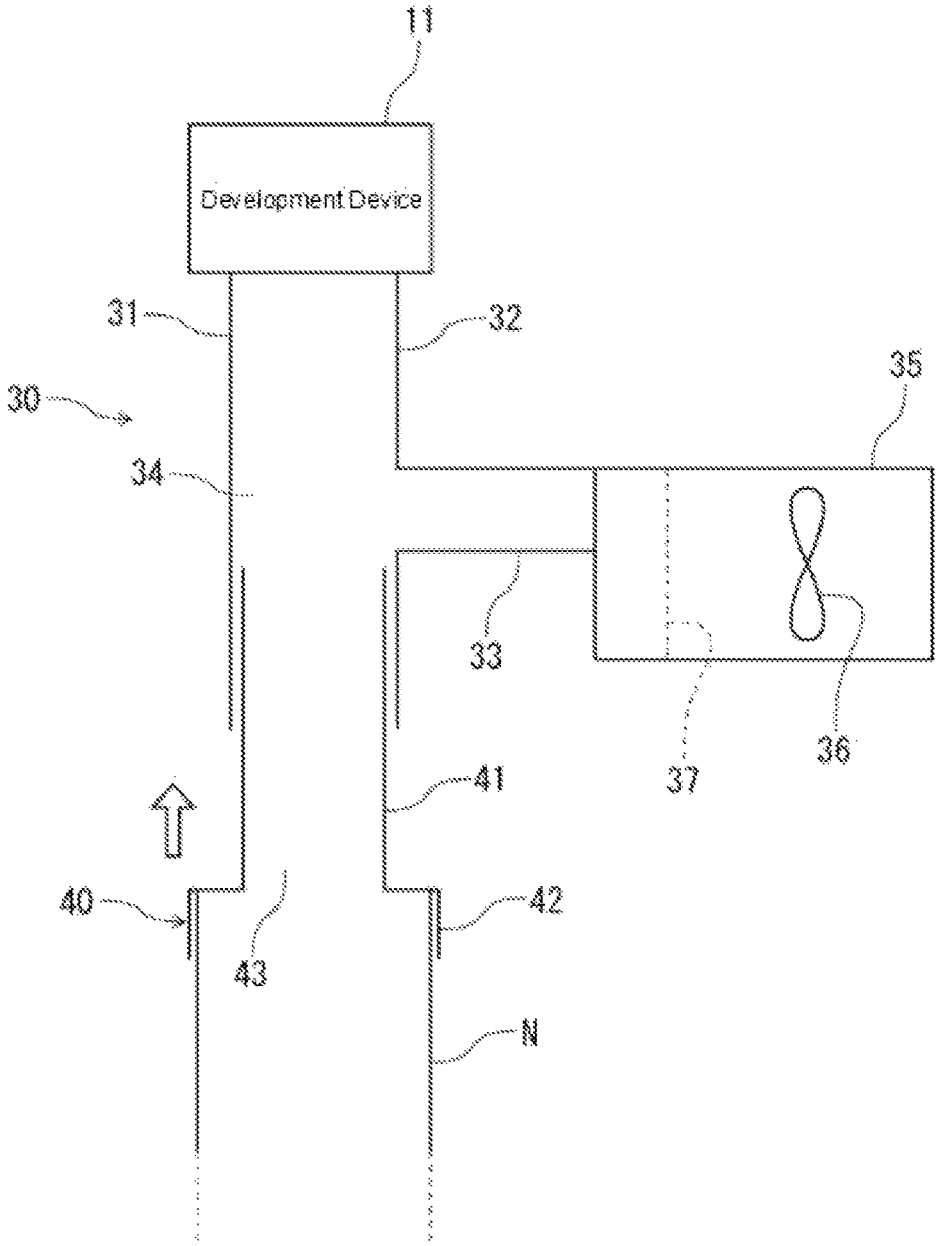
FIG. 6 schematically illustrates a configuration of the toner collecting device according to the embodiment.
Figure 7:
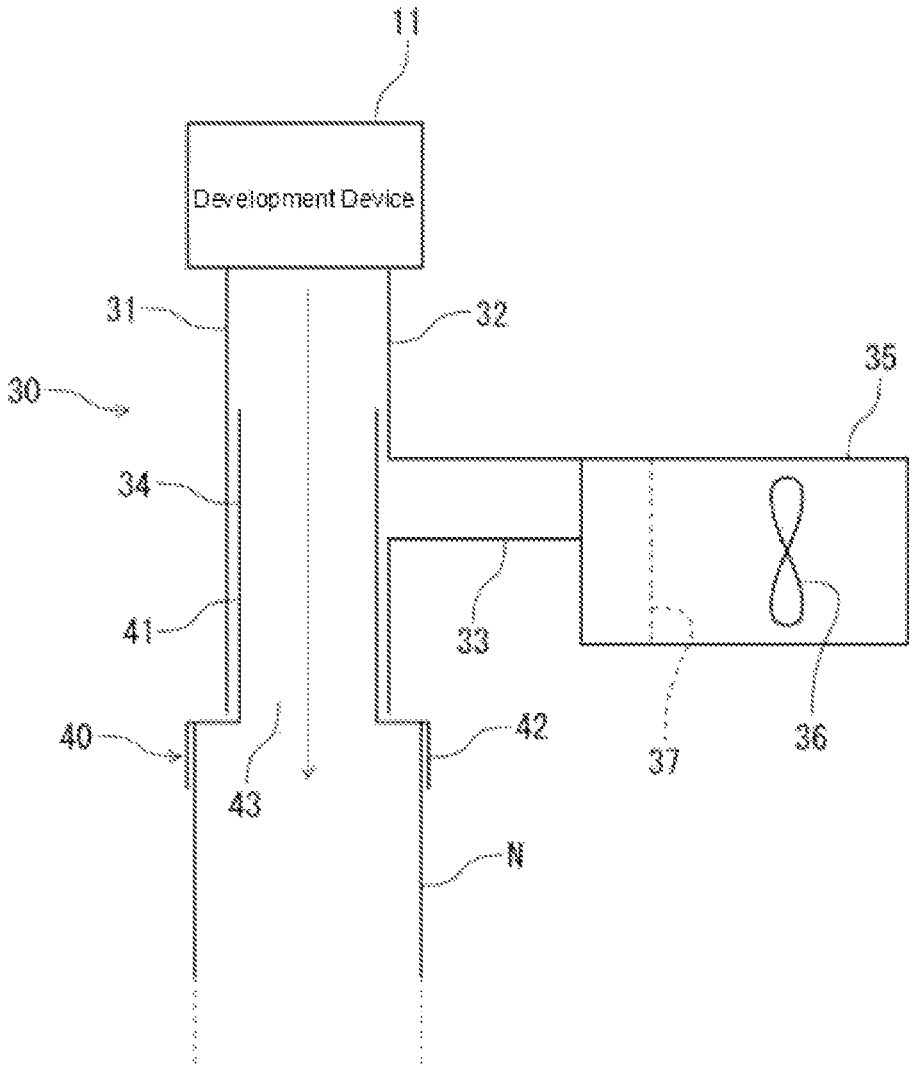
FIG. 7 schematically illustrates a configuration of the toner collecting device according to the embodiment.

The collecting box 35 functions to suction and collect the toner around the development device 11, that is, the toner particles scattered in the development device 11. Specifically, as illustrated in FIGS. 5 to 7, the collecting box 35 includes a suction fan 36. The suction effect of the suction fan 36 causes the toner particles scattered in the development device 11 to pass through the suction duct 31 with air and to be drawn into the collecting box 35. The collecting box 35 includes a filter 37. The toner drawn into the collecting box 35 is adsorbed on the filter 37. The air drawn into the collecting box 35 passes through the filter 37 to be discharged to outside. And thus, the toner particles scattered in the development device 11 are collected into the collecting box 35.

A suction port 43, which suctions up the toner inside of the suction duct 31 from the outside of the suction duct 31, is located in the middle of the suction duct 31.

Specifically, a suction mechanism 40 having the above-described suction port 43 is provided in the bending portion 34 of the suction duct 31. The suction mechanism 40 includes a cylinder 41 and a flange portion 42. The cylinder 41 is inserted into the duct upstream part 32. The cylinder 41 is movably constituted along an axial direction (the vertical direction in FIGS. 5 to 7) of the duct upstream part 32. The flange portion 42 includes the suction port 43, and is connected to the outer end portion (the lower end portion in FIGS. 5 to 7) of the cylinder 41. A cover 44 that closes the suction port 43 is located in the flange portion 42. That is, the suction port 43 is constituted so as to be openable/closable.

The suction mechanism 40 is constituted such that the cylinder 41 closes the duct downstream part 33 by pressing the flange portion 42 to move the cylinder 41 in the axial direction of the duct upstream part 32. In the suction mechanism 40, the suction port 43 is opened toward the duct upstream part 32 among the duct upstream part 32 and the duct downstream part 33. Next, the operations of the toner collecting device 30 will be described with reference to FIGS. 5 to 7.

First, the duct downstream part 33 is not closed by the cylinder 41 of the suction mechanism 40 but is opened when collecting the toner particles scattered in the development device 11 to the collecting box 35 (toner collection operation). The suction port 43 is closed by the cover 44. In this state, the driving action of the suction fan 36 causes the toner particles scattered in the development device 11 to pass through the suction duct 31 with air and to be drawn into the collecting box 35 (see an arrow mark illustrated in FIG. 5). Here, the suction port 43 is closed by the cover 44, and this ensures that the suction force of the suction fan 36 can be effectively supplied toward the direction of the around the development device 11. And thus, the toner particles scattered in the development device 11 are collected.

For the above-described toner collection operation, it is difficult to make the whole toner suctioned by the suction duct 31 to reach the collecting box 35. Some of the toner attach to an inner wall of the suction duct 31 and accumulate in there. Therefore, a duct cleaning operation is performed according to the embodiment.

For the duct cleaning operation, as illustrated in FIG. 6, the cover 44 of the suction port 43 is demounted and a cleaner suction nozzle N is pressed against the flange portion 42. Subsequently, the suction nozzle N is pressed with the flange portion 42 (see a white arrow mark illustrated in FIG. 6). Consequently, the cylinder 41 moves in the axial direction of the duct upstream part 32, and the duct downstream part 33 is closed by the cylinder 41, as illustrated in FIG. 7. In this state, the driving action of a cleaner causes the toner accumulated in the suction duct 31 to be drawn with air into the cleaner (see the arrow mark illustrated in FIG. 7). Here, the duct downstream part 33 is closed, and this ensures that the suction force of the cleaner can be concentratedly supplied to the duct upstream part 32 without being supplied in the collecting box 35. And thus, the toner accumulated in the suction duct 31 is removed. The duct cleaning operation ensures the suction of not only the toner accumulated in the suction duct 31 but also the toner accumulated in around the development device 11.

As described above, according to the toner collecting device 30 of the embodiment, the suction port 43 is located in the middle of the suction duct 31 so as to suction the toner inside of the suction duct 31 from the outside of the suction duct 31. This ensures that the toner accumulated in the suction duct 31 can be suctioned to be removed by the toner collection operation. Thus, an increase of a distribution resistance within the suction duct 31 can be reduced, and accordingly, a decrease of the toner collection rate can be suppressed.

In the suction duct 31, as approaching to the development device 11, that is, with increasing distance from the suction fan 36, the suction force supplied by the suction fan 36 become weak, which causes the toner to accumulate markedly. In response to this situation, according to the toner collecting device 30 of the embodiment, the suction port 43 is located at the bending portion 34 of the suction duct 31 and opened toward the duct upstream part 32 among the duct upstream part 32 and the duct downstream part 33. This ensures that a flow of the toner and air from the side of the development device 11 to the suction port 43 becomes substantially linear regarding the duct upstream part 32. Consequently, the distribution resistance of the toner and air can be as lower as possible in the duct upstream part 32. Therefore, the toner, which is accumulated in the duct upstream part 32 and around the development device 11, can be effectively suctioned to be removed.

According to the toner collecting device 30 of the embodiment, the cylinder 41 closes the duct downstream part 33 by pressing the flange portion 42 to move the cylinder 41 in the axial direction of the duct upstream part 32. This ensures that the suction force of the cleaner can be concentratedly supplied to the duct upstream part 32 without being supplied in the collecting box 35. Thus, the toner, which is accumulated in the duct upstream part 32 and around the development device 11, can be more effectively suctioned to be removed.

According to the toner collecting device 30 of the embodiment, the suction port 43 is constituted so as to be openable/closable. Thus, closing the suction port 43 can prevent the toner from flowing out of the suction port 43 to the outside when performing a collection of the toner particles scattered in the development device 11 (during the toner collection operation). In addition, opening or closing the suction port 43 with the cover 44 can facilitate its operations of the open and close in the embodiment.

Figure 4:
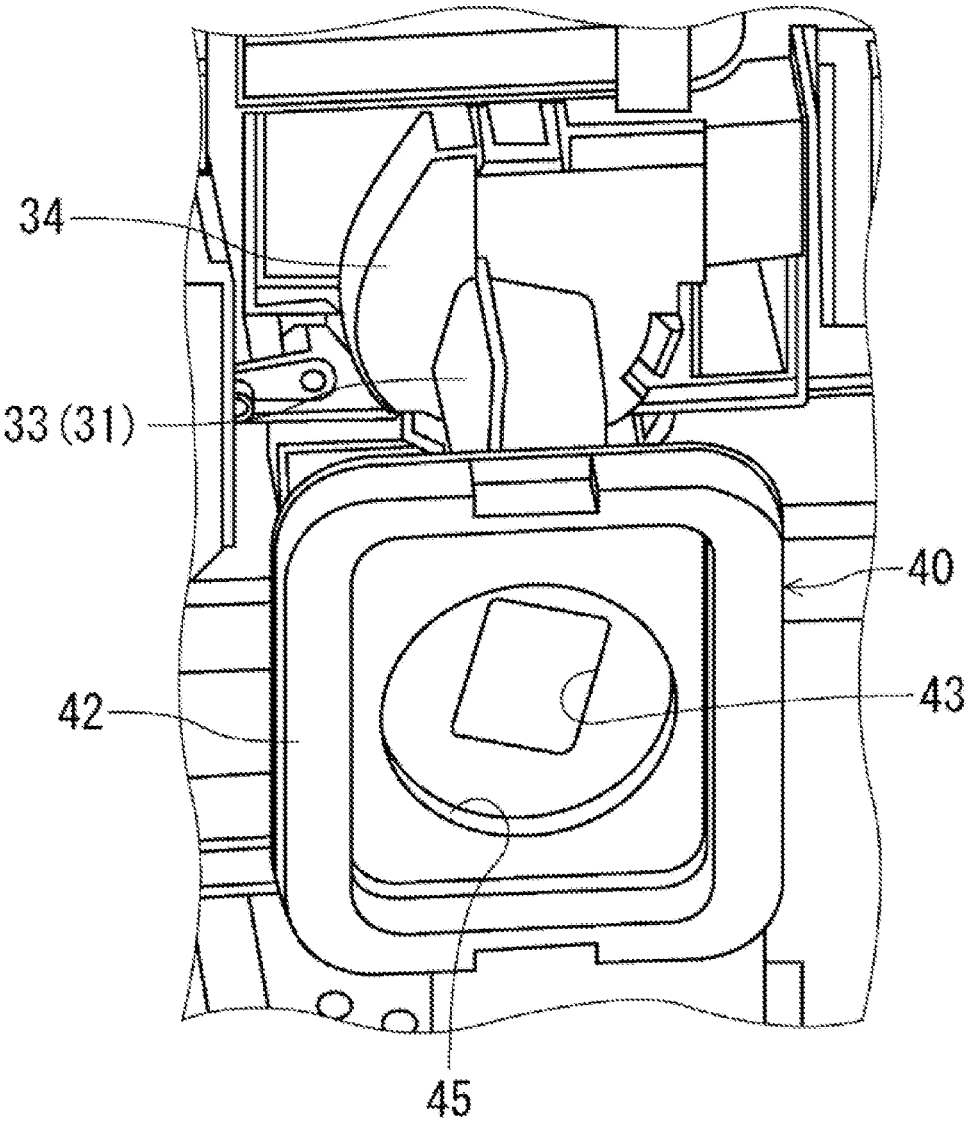
FIG. 4 diagonally illustrates a configuration of the flange portion of the suction mechanism according to the embodiment where the cover is demounted.

According to the toner collecting device 30 of the embodiment, as illustrated in FIG. 4, an adapter 45 of the suction nozzle N is located at the flange portion 42. The adapter 45 recedes in a formed circular shape in plan view such that a distal end of the suction nozzle N is fitted into the adapter 45 to cover the suction port 43. Locating the adapter 45 facilitates pressing the suction nozzle N against the flange portion 42 so as to cover the suction port 43. In addition, the suction force of the cleaner can be effectively supplied in the suction duct 31 because the suction port 43 can be securely covered with the suction nozzle N.

Modification of the Embodiment

The toner collecting device 30 according to this modification is configured by changing the configuration of the suction mechanism 40 in the above-described embodiment. Specifically, as illustrated in FIGS. 8 and 9, in the suction mechanism 40 according to the modification, the cylinder 41 is omitted, and the flange portion 42 having the suction port 43 is located at the bending portion 34.

Figure 8:
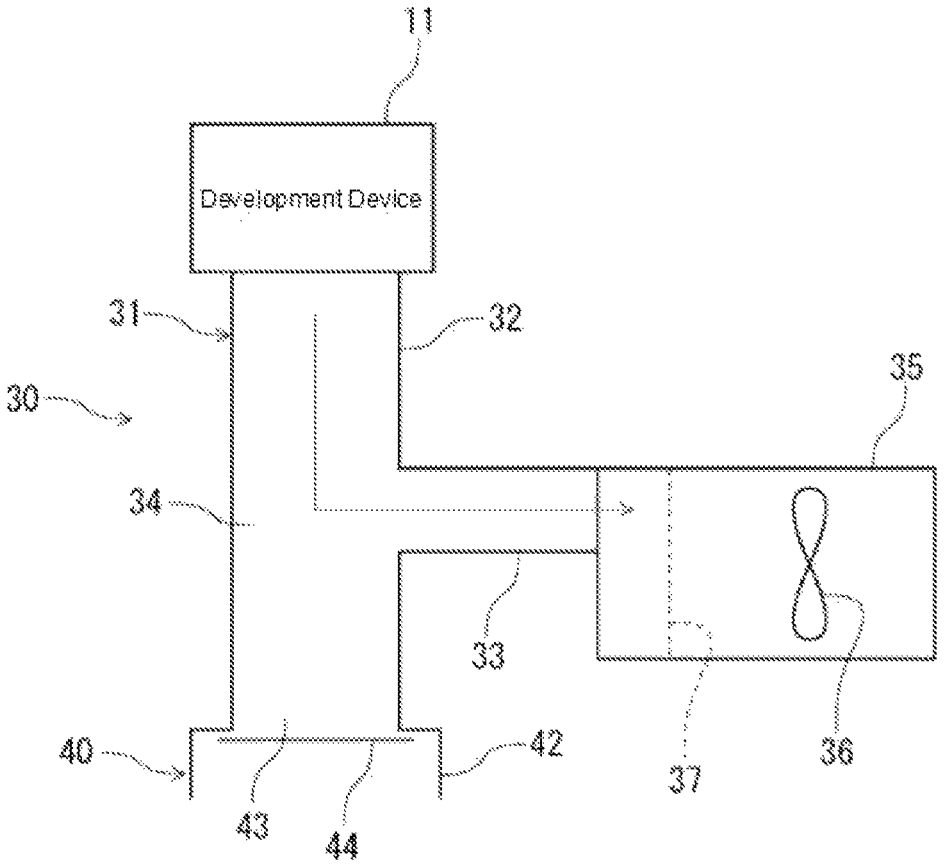
FIG. 8 schematically illustrates a configuration of the toner collecting device according to a modification of the embodiment.

For the toner collection operation according to the modification, as illustrated in FIG. 8, the suction fan 36 is driven in a state where the suction port 43 is closed by the cover 44. Similarly to the above-described embodiment, this causes the toner particles scattered in the development device 11 to pass through the suction duct 31 with air and to be drawn into the collecting box 35 (see the arrow mark illustrated in FIG. 8). And thus, the toner particles scattered in the development device 11 are collected.

Figure 9:
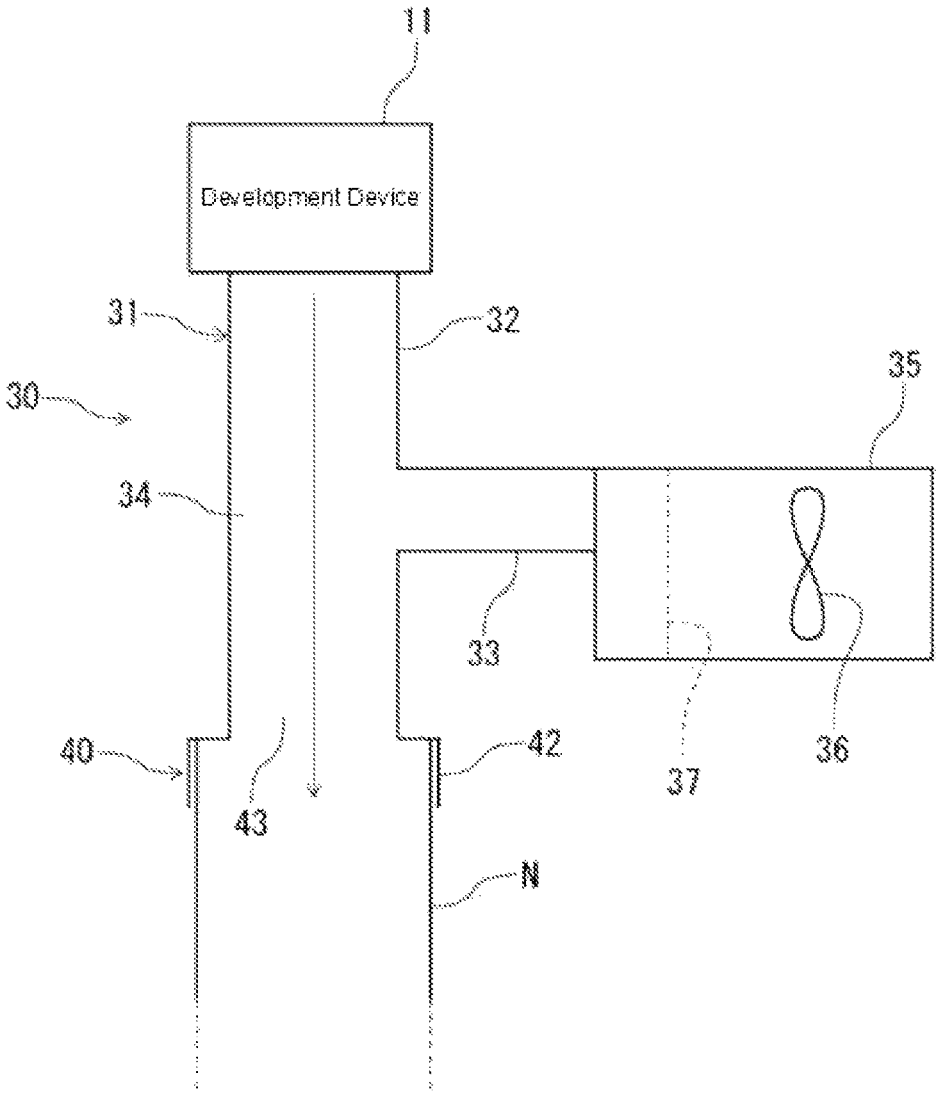
FIG. 9 schematically illustrates a configuration of the toner collecting device according to the modification of the embodiment.

For the duct cleaning operation according to the modification, as illustrated in FIG. 9, the cover 44 of the suction port 43 is demounted, and the cleaner suction nozzle N is pressed against the flange portion 42. In this state, the driving action of the cleaner causes the toner accumulated in the suction duct 31 and around the development device 11 to be drawn with air into the cleaner (see the arrow mark illustrated in FIG. 9).

Also in the modification, since the suction port 43 is opened toward the duct upstream part 32 among the duct upstream part 32 and the duct downstream part 33, the flow of the toner and air from the side of the development device 11 to the suction port 43 becomes substantially linear regarding the duct upstream part 32 during the duct cleaning operation. Consequently, the distribution resistance of the toner and air can be as lower as possible in the duct upstream part 32. Therefore, the toner, which is accumulated in the duct upstream part 32 and around the development device 11, can be effectively suctioned to be removed. Other parts of configuration and advantageous effects in the modifications are identical to those in the above-described embodiment.

As stated previously, the disclosure is useful for the developer collecting device, which suctions and collects the developer scattered in the development device, and the image forming apparatus having the same.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A developer collecting device, comprising:

a suction duct having an inlet end and an outlet end, the inlet end for disposal adjacent to a development device, the suction duct being bent midway to form a bending portion, and, with respect to the bending portion, including a duct upstream part toward the inlet end and a duct downstream part toward the outlet end;

a collecting box connected to the outlet end of the suction duct and configured to, via the suction duct, suction and collect developer around the development device adjacent to which the suction duct is disposed;

a cylinder inserted into the duct upstream part; and a suction mechanism disposed midway along the suction duct at the bending portion such as to be opened toward the duct upstream part, the suction mechanism including a flange portion having a suction port that is openable and closable, the flange portion being connected to an outer end portion of the cylinder, the suction mechanism being configured to suction the developer inside the suction duct from outside the suction duct, and being configured to press the flange portion to move the cylinder axially toward the duct upstream part so as to cause the cylinder to close the duct downstream part.

2. The developer collecting device according to claim 1, wherein the suction port includes an adapter into which a cleaner suction nozzle is fittable.

3. The developer collecting device, according to claim 1, wherein the suction mechanism includes a cover that opens and closes the suction port.

4. The developer collecting device, according to claim 1, wherein the suction duct is configured such that in the bending portion airflow passing from the duct upstream part to the duct downstream part has a right angle.

5. An image forming apparatus, comprising the developer collecting device according to claim 1.

* * * * *